US006170300B1

(12) United States Patent
Schmid et al.

(10) Patent No.: US 6,170,300 B1
(45) Date of Patent: Jan. 9, 2001

(54) FLAT KNITTING MACHINE

(75) Inventors: Franz Schmid, Bodelshausen; Winfried Kapitel, Rottenburg, both of (DE)

(73) Assignee: H. Stoll GmbH & Co., Reutlingen (DE)

( * ) Notice: Under 35 U.S.C. 154(b), the term of this patent shall be extended for 0 days.

(21) Appl. No.: 09/262,369

(22) Filed: Mar. 3, 1999

(30) Foreign Application Priority Data

Mar. 9, 1998 (DE) ..... 198 10 117

(51) Int. Cl.[7] ..... D04B 7/04

(52) U.S. Cl. ..... 66/64; 66/60 R

(58) Field of Search ..... 66/60 R, 67, 64, 66/114, 115

(56) References Cited

U.S. PATENT DOCUMENTS 1,800,265 4/1931 Rolston .
4,586,352 5/1986 Morard et al. .

FOREIGN PATENT DOCUMENTS 1 091 977 4/1955 (FR) .

*Primary Examiner*—Danny Worrell
(74) *Attorney, Agent, or Firm*—Michael J. Striker

(57) ABSTRACT

A flat knitting machine has a needle bed support, a machine base, the needle bed support and the machine base being formed as a single assembly.

13 Claims, 5 Drawing Sheets

FLAT KNITTING MACHINE

BACKGROUND OF THE INVENTION

The present invention relates to a flat knitting machine with a needle bed support and a machine base.

Flat knitting machines have a bending-resistant and torsion-resistant needle bed support which as a rule is formed as a cast or welded structure and rests on two lateral posts. The posts are also formed as cast or welding structures and connected with one another to reinforce the machine design. The needle bed support and the machine base are separate parts which are produced separately and subsequently are screwed or welded with one another. Moreover, the needle bed support and the machine base are the parts which are relatively expensive to manufacture.

SUMMARY OF THE INVENTION

Accordingly, it is an object of the present invention to provide a flat knitting machine which has a simpler and less expensive construction.

In keeping with these objects and with others which will become apparent hereinafter, one feature of present invention resides, briefly stated in a flat knitting machine with a needle bed support and a machine base, in which the needle bed support and the machine base are formed as an assembly.

In the flat knitting machine designed in accordance with the present invention, the mounting steps for connecting the needle bed support with the machine base are no longer needed. Moreover, the currently used welding or cast constructions for the needle bed support and the machine base can be eliminated.

Preferably, the outer casing of the needle bed support in the machine base can be formed of a single plate bending part or of several plate bending parts connected with one another. The total machine structure, including the bottom, the rearwall, the needle bed support, and the lateral walls of the needle bed support can be produced from a single material, for example a steel sheet plate.

It is especially advantageous when at least one plate bending part is produced from a flat plate cutout which is already provided with all openings, passages, recesses, edge cuts required for the machine.

In order to obtain a required rigidity and torsion strength, the plate bending part or parts can be reinforced by corrugations and/or transverse webs extending transversely to the longitudinal direction of the machine, and provided at least locally.

The main reinforcing can be obtained for example in the region of the end sides of the machine by vertical supporting plates arranged over the whole machine cross-section. This supporting plates can be also reinforced by corrugations or edging.

In the region of the needle bed support, a knitted article passage opening can be provided. It can be flanked at both sides by longitudinal plates extending along the machine and forming hollow profiles together with the plate bending part of the machine. The hollow profile can be additionally reinforced by a transverse sheet metal. Therefore, the hollow profile form the best resistance against bending and torsion. The total stability of the needle bed support for this construction is comparable with the stability of a cast needle bed support.

The shape of the profile and the edge radii are selected so that with the minimal plate thickness such a rigidity is obtained which is required for takeing up the occurring loads without shape changes which can interfere with the machine operation.

For supporting at least a greater part of the structural groups which belong to the loop formation, two left or right structural group supports can be arranged on the machine and mounted on the plate bending part or parts. They support the structural groups for the loop formation, such as both needle beds, a needle bed offset device, as well as a product withdrawal device. The structural group supports can be formed as cast parts which are connected by screws or pins with at least one plate bending part.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF PREFERRED EMBODIMENTS

Figure 1:
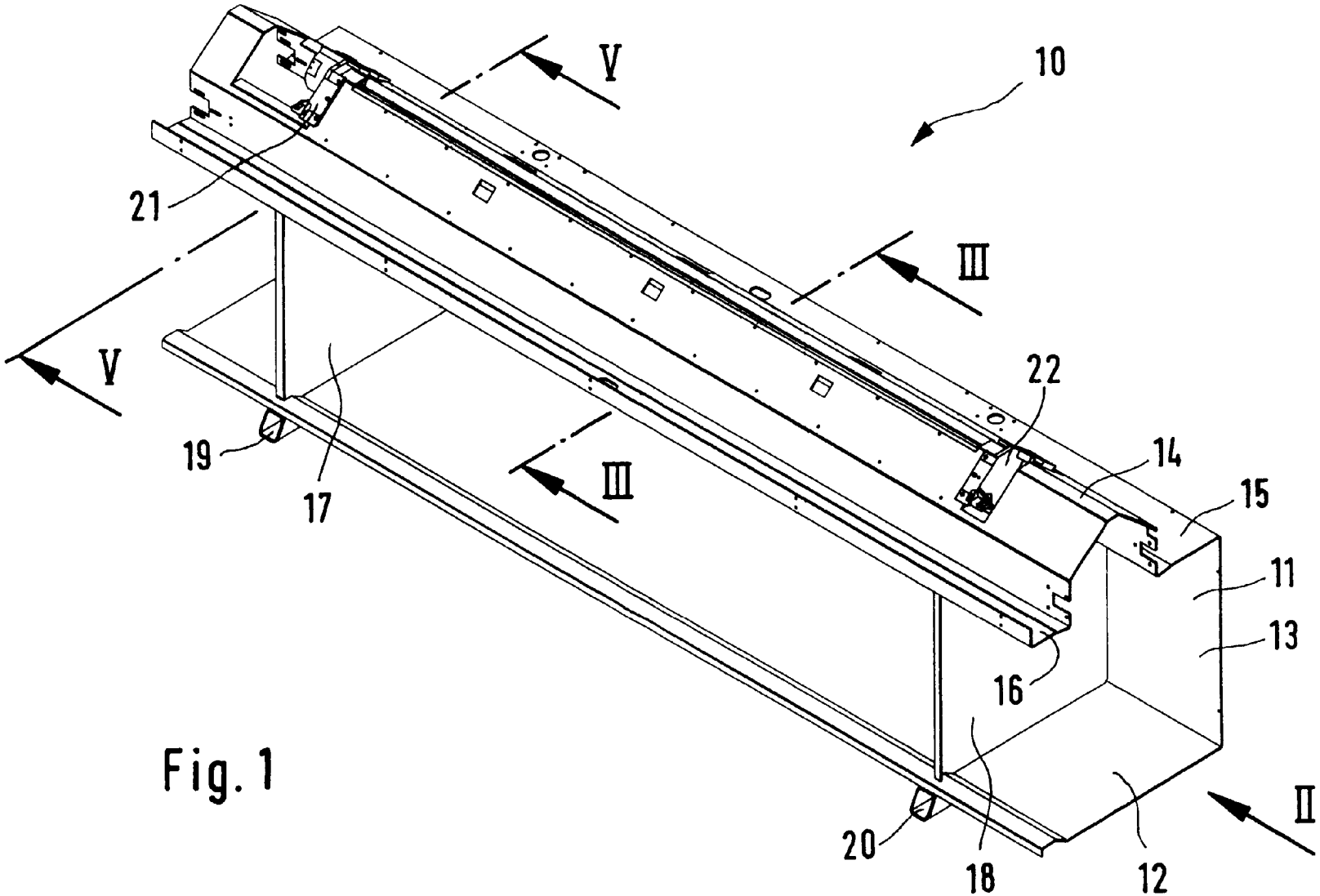
FIG. 1 is a perspective view of a needle bed support and a machine base of a flat knitting machine, produced from a plate bending part.

FIG. 1 is a view showing an outer casing of a flat knitting machine 10, which is a shown example is produced from a single plate bending part 11. The plate bending part 11 forms a bottom 12, a rear wall 13 and a needle bed support 14, which is flanked by a rear wall 15 and a front wall 16.

Figure 2:
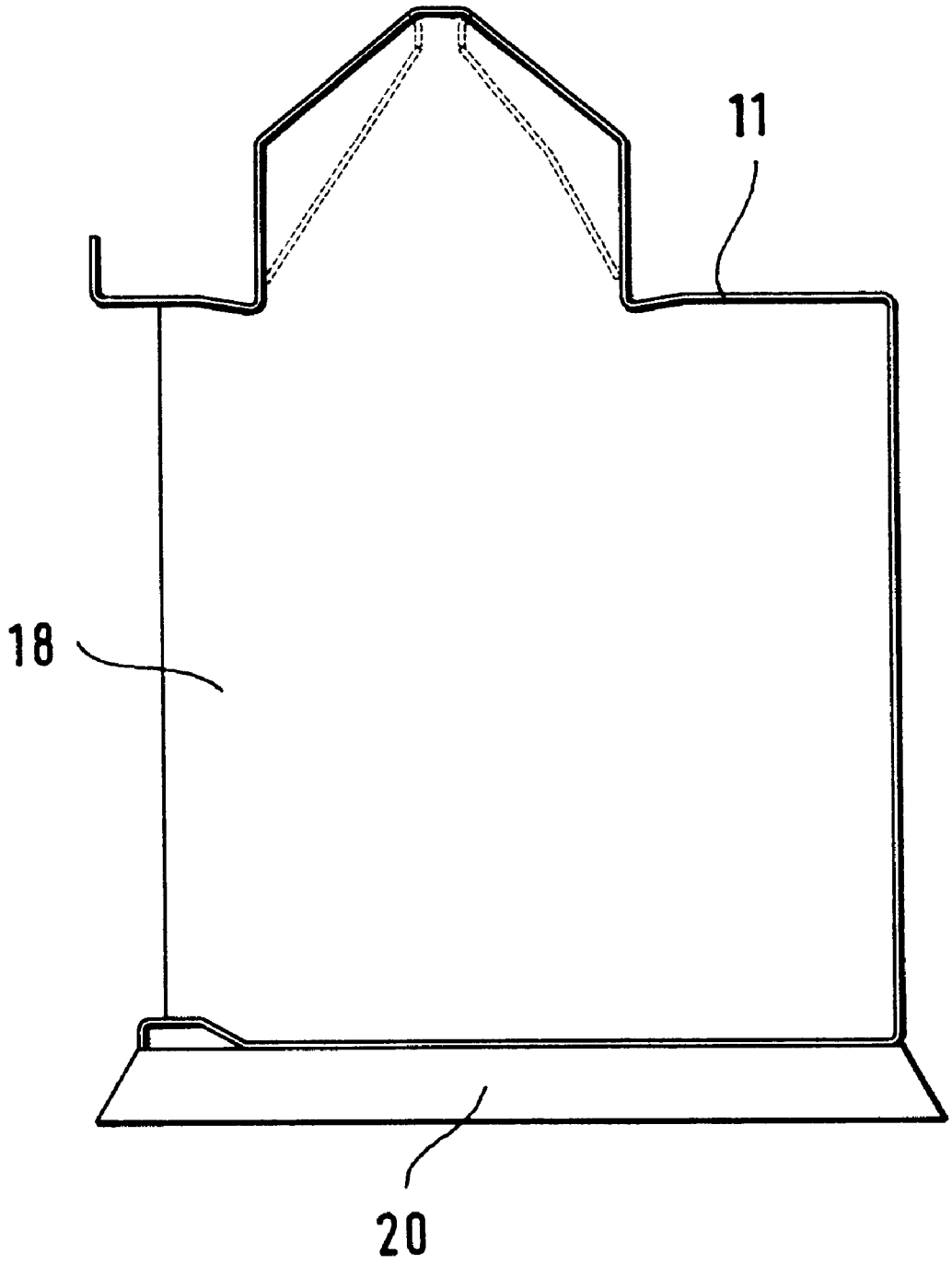
FIG. 2 is an end view of the construction shown in FIG. 1.

Vertical supporting metal plates 17 and 18 are arranged at both end sides of the hollow profile of the needle bed support 14 of the machine 10 as shown in FIG. 2. The supporting metal plates extend over the whole cross-section of the casing structure.

Rectangular tubes 19 and 20 are arranged on the bottom 12 of the machine 10 in the region of the welding seam between the supporting metal plates 17, 18 and the bottom 12. The whole machine 10 rests on the rectangular edge tubes 19 and 20. In the region of the outer ends of the needle bed supports 14, moreover two structural group supports 21, 22 are arranged. They receive not shown structural elements for loop formation, such as needle beds, a needle bed offset device, a product withdrawal and the like.

Figure 3:
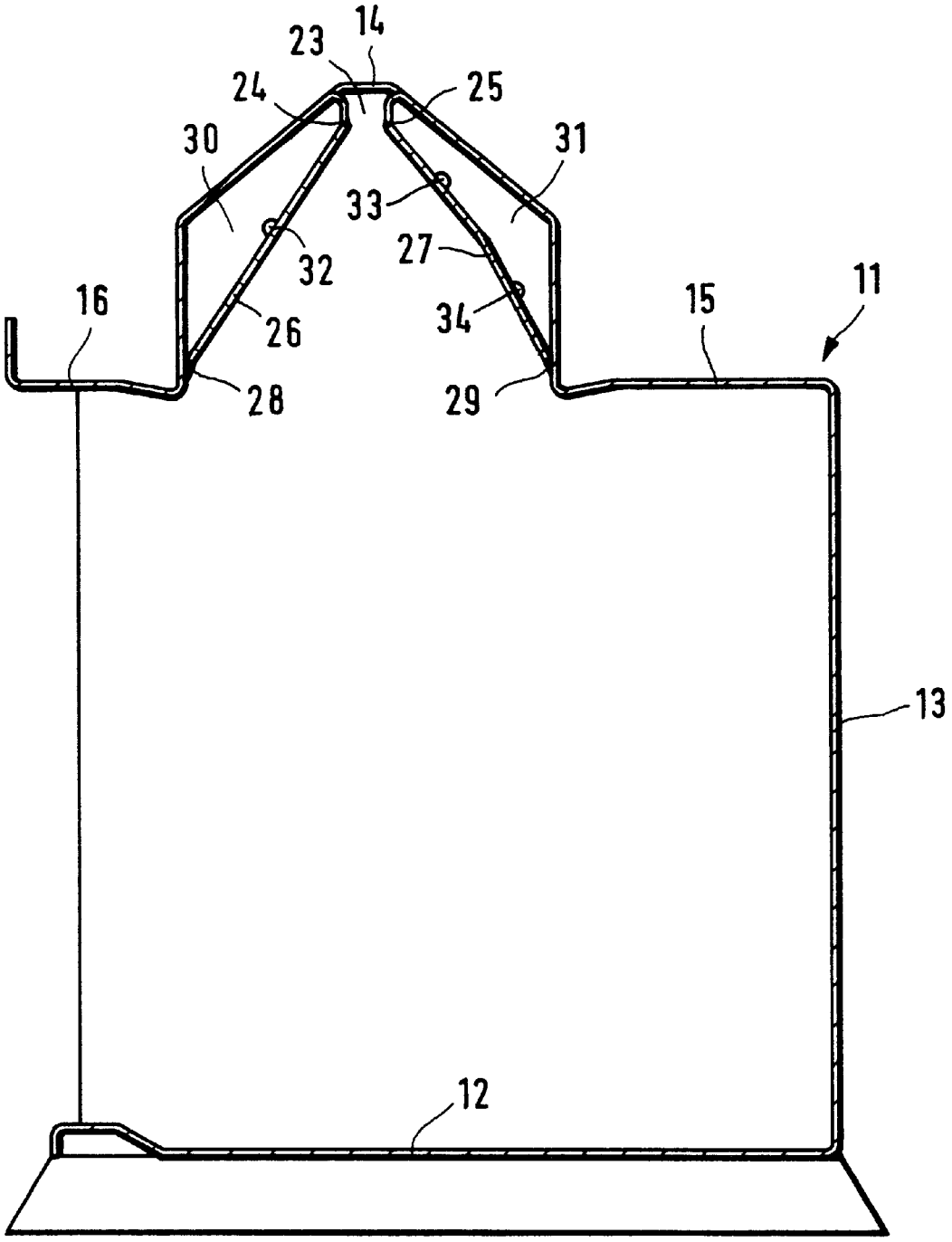
FIG. 3 is a view showing a section taken along the plane III in the construction shown in FIG. 1.

The right supporting metal sheet 18 which extends over the whole cross-section of the machine as well as the support of the machine on the rectangular tube 20, are shown on the side view of FIG. 2. The diagram of FIG. 3 illustrates the machine design in the region of the throughgoing opening 23 for the knitted product in the needle bed support 14. Longitudinal metal plates 26 and 27 are welded on the edges of the plate bending part 11 for forming the throughgoing opening 23. They extend over the welding lines 24, 25 over the total length of the throughgoing opening 23. The longitudinal metal plates 26, 27 are also welded over the lines 28, 29 with the plate bending part 11. They form together with them a hollow profiles in the region of the needle bed support 14. These hollow profiles are reinforced by transverse metal plates 30, 31. The metal plates are connected with the longitudinal blades 26, 27 by point welds 32, 33, 34.

Figure 4:
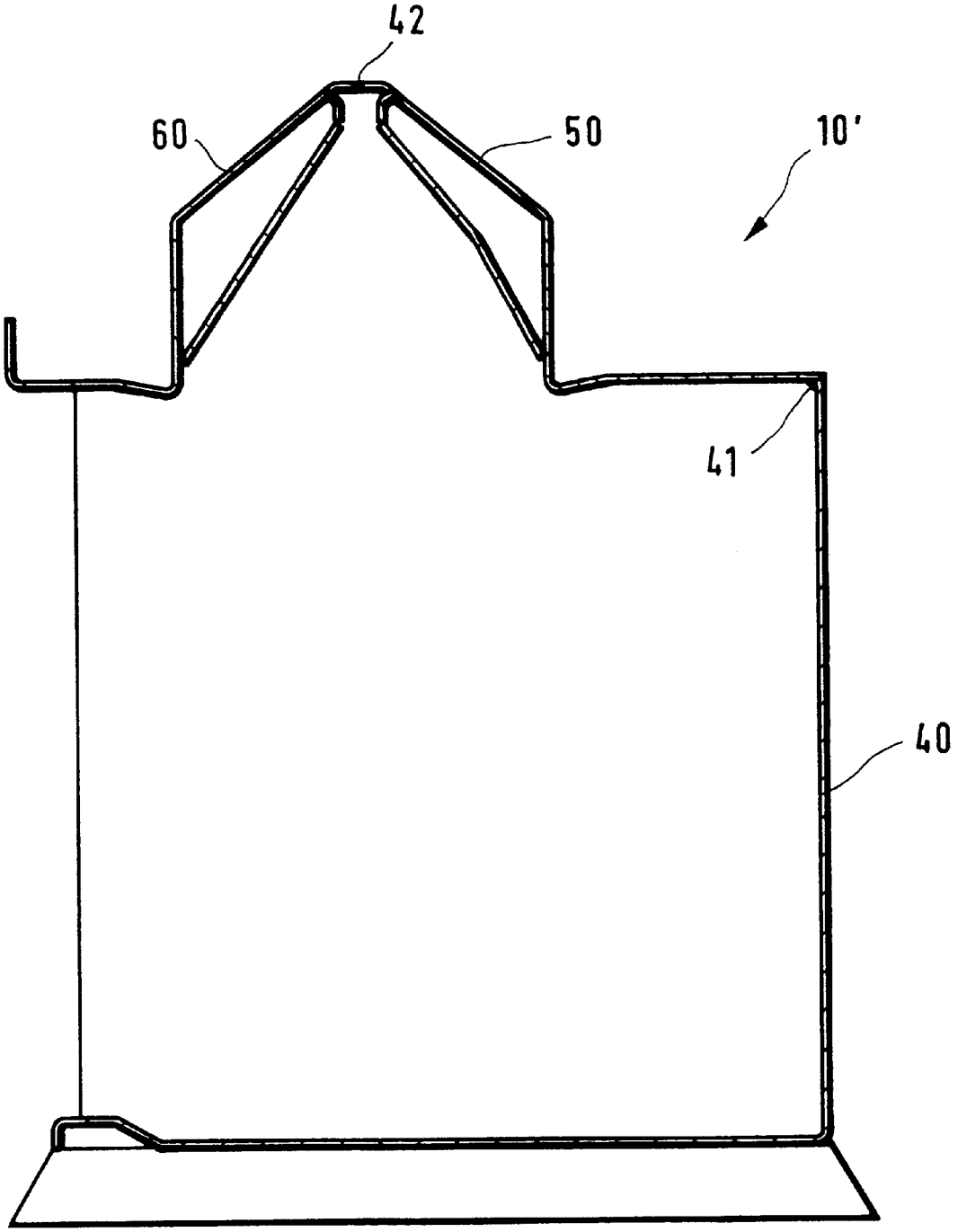
FIG. 4 is a view substantially corresponding to the view of FIG. 3 but showing a second embodiment of a needle bed support and a machine base of a flat knitting machine.

FIG. 4 shows a cross-section of a machine 10' which corresponds to FIG. 3. The construction of its casing is composed of three plate parts 40, 50, 60, and the parts 40, 50, 60 are connected with one another on the welding lines 41 and 42. The shown subdivision of the total casing of the machine into several plate parts 40, 50, 60 is shown in FIG. 2 as an exemplary embodiment. It is to be understood that also other subdivision into any number of individual plate bending parts is possible.

Figure 5:
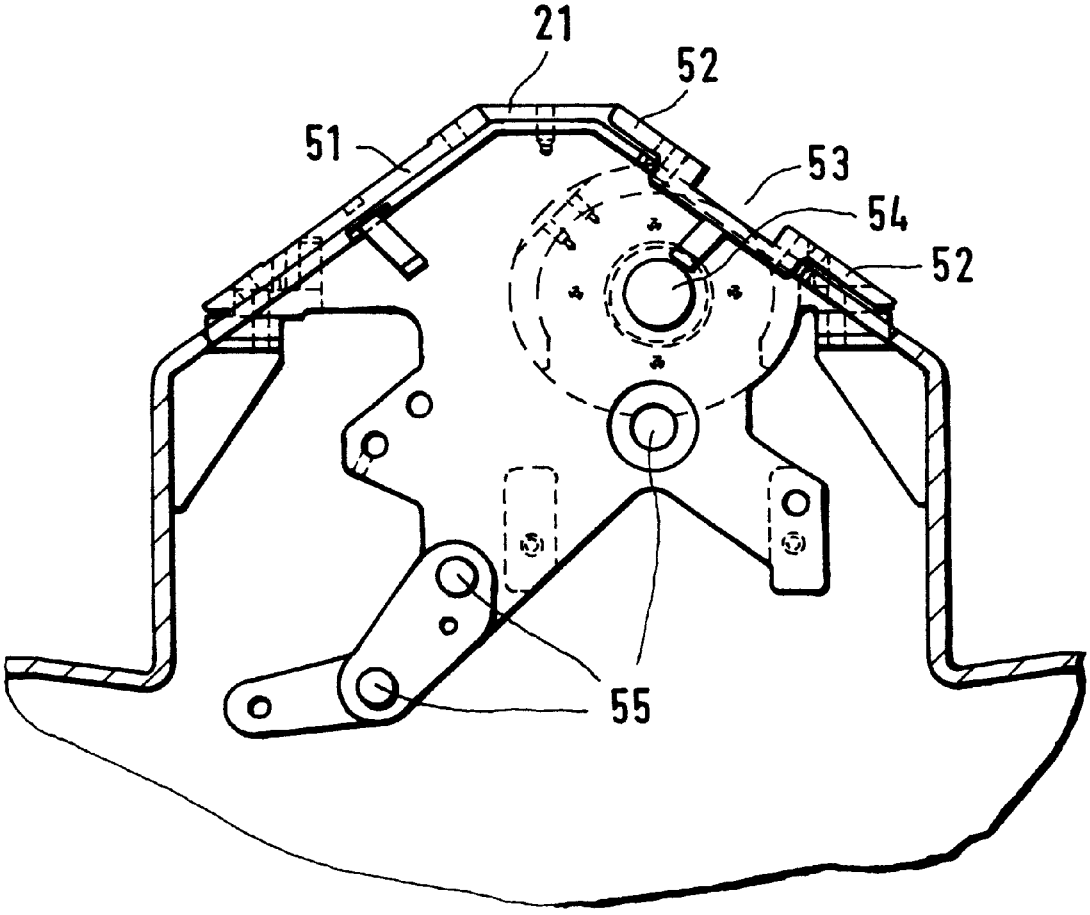
FIG. 5 is a partial section taken along the plane V in the construction of FIG. 1.

FIG. 5 shows a section through the structural group support 21 of FIG. 1. Reference numeral 51 identifies a bearing surface for the front needle bed and reference numeral 52 identifies a bearing surface for the rear needle bed. A bearing groove 53 for a guiding element of the rear needle bed which is displaceable in the longitudinal direction, is provided in the bearing surface 52 for the rear needle bed. Moreover, the structural group support 21 has a bearing 54 for an offset device for the rear needle bed. A bearing 55 for a product discharge device is provided on the lower side of the structural group support 21.

It will be understood that each of the elements described above, or two or more together, may also find a useful application in other types of constructions differing from the types described above.

While the invention has been illustrated and described as embodied in flat knitting machine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A flat knitting machine, comprising a needle bed support; a machine base, said needle bed support and said machine base being formed as a single assembly said needle bed support and said machine base having a common outer casing which is composed of a single longitudinally extending plate bending part; and a throughgoing opening for a knitted article provided in a region of said needle bed support; longitudinal plates extending along the machine at both sides of said throughgoing opening and flanking the latter, said longitudinal plates being connected with said plate bending part so as to form hollow profiles.

2. A flat knitting machine, comprising a needle bed support; a machine base, said needle bed support and said machine base having a common outer casing which is composed of a single longitudinally extending plate bending part.

3. A flat knitting machine as defined in claim 1, wherein said plate bending part is formed as a flat plate cutout provided with all openings, passages, recesses and edge cuts required for the machine.

4. A flat knitting machine as defined in claim 1, wherein at least one of said plate bending parts is formed as a flat plate cutout provided with reinforcing formations selected from the group consisting of corrugation and transverse webs oriented transversely to a longitudinal direction of the machine.

5. A flat knitting machine as defined in claim 1, wherein said plate bending part is provided with reinforcing formations selected from the group consisting of corrugations and transverse webs oriented transversely to a longitudinal direction of the machine.

6. A flat knitting machine as defined in claim 3, wherein at least one of said plate bending parts is provided with reinforcing formations selected from the group consisting of corrugations and transverse webs oriented transversely to a longitudinal direction of the machine.

7. A flat knitting machine as defined in claim 1; and further comprising two vertical supporting plates extending over a whole cross-section of the machine.

8. A flat knitting machine as defined in claim 1; and further comprising transverse plates which reinforce said hollow profiles.

9. A flat knitting machine as defined in claim 1; and further comprising structural groups which take part in a loop formation; and two structural group supports which are arranged at a left side an at a right side of the machine and mounted on at least one of said plate bending parts.

10. A flat knitting machine as defined in claim 9, wherein said structural group supports are cast parts which is connected with at least one of said plate bending parts.

11. A flat knitting machine as defined in claim 10, wherein said cast part is screwed with at least one of said plate bending parts.

12. A flat knitting machine as defined in claim 10, wherein said cast part is pinned with at least one of said plate bending parts.

13. A flat knitting machine as defined in claim 1; and further comprising two rectangular tubes which extend transversely to a longitudinal direction of the machine and support the machine.

* * * * *